United States Patent [19]

Dwight

[11] Patent Number: 4,464,005

[45] Date of Patent: Aug. 7, 1984

[54] TEMPERATURE STABILIZED ELECTRICAL CONNECTOR

[75] Inventor: John L. Dwight, Andover, Mass.

[73] Assignee: Precision Connector Designs, Inc., Winchester, Mass.

[21] Appl. No.: 381,020

[22] Filed: May 24, 1982

[51] Int. Cl.[3] ..... H01R 13/00

[52] U.S. Cl. ..... 339/112 R; 339/147 R; 339/176 MP

[58] Field of Search ..... 339/112 R, 75 MP, 176 MP, 339/272 R, 272 A, 147 R; 374/152, 208, 210

[56] References Cited

U.S. PATENT DOCUMENTS 3,482,201 12/1969 Schneck ..... 339/176 MP X 4,082,407 4/1978 Smorzaniuk et al. ..... 339/112 R

FOREIGN PATENT DOCUMENTS 2020123A 11/1979 United Kingdom ..... 339/147 R

*Primary Examiner*—Eugene F. Desmond
*Assistant Examiner*—Steven C. Bishop

[57] ABSTRACT

An electrical connector with an elongated heat-conducting, electrically-insulating member contacting electrical contacts on both sides of it, so that all contacts are maintained at the same temperature, to avoid voltage and/or current discrepancies of thermal sensing conductors through contacts owing to temperature differences.

8 Claims, 3 Drawing Figures

FIG 1
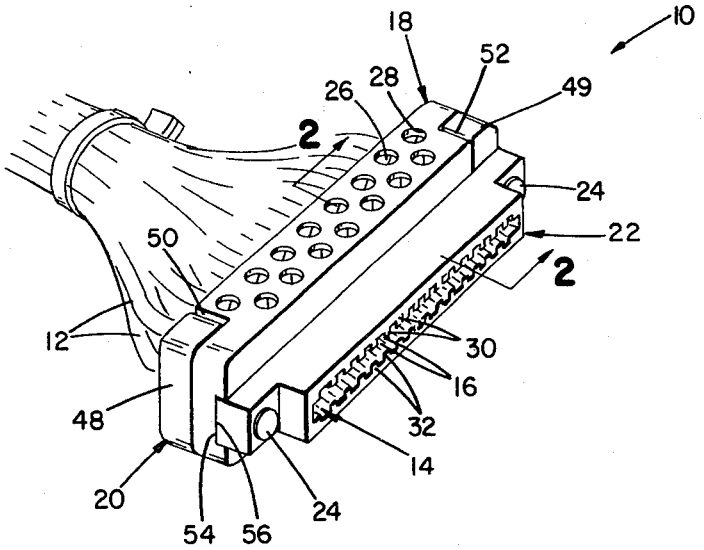
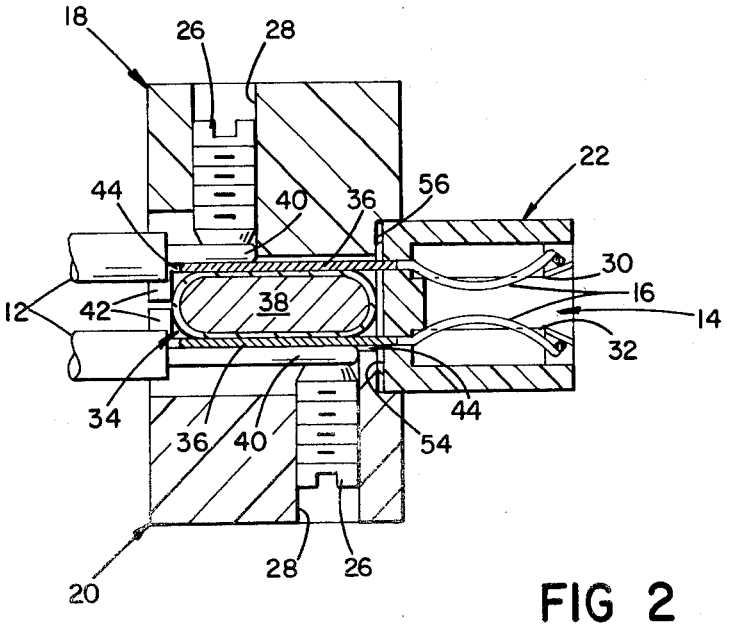
FIG 2

TEMPERATURE STABILIZED ELECTRICAL CONNECTOR

FIELD OF THE INVENTION

The invention relates to a connector for making a plurality of electrical connections.

BACKGROUND OF THE INVENTION

Printed circuit boards and other supporting members for electronic components are often connected to wires by electrical connectors having contacts for engaging standard-sized conducting members for the electronic components. In some applications, it is desirable to maintain the contacts at the same temperature, to avoid voltage and/or current distortion of thermal sensing conductors through contacts owing to temperature differences, and some commercially available switches have thus been provided with heat-conducting, electrically-insulating members that touch a plurality of contacts.

SUMMARY OF THE INVENTION

It has been discovered that an electrical connector can be advantageously provided with an elongated heat-conducting, electrically-insulating member between two rows of contacts, to provide temperature stabilization for both rows simultaneously.

In preferred embodiments, the heat-conducting member is a hard anodized aluminum bar; the connector provides electrical connection between a plurality of wires and metal conductors near the edge of a printed circuit board; screws hold the contacts in heat-conducting relationship with the heat-conducting member; a temperature sensor also contacts the heat-conducting member, to provide information useful in analyzing signals; the heat-conducting member is mounted within a recess provided by two plastic pieces, and tabs on the two plastic pieces and a third plastic piece, in which the contacts are embedded, hold the heat-conducting member in place; and screws in the plastic pieces that hold the contacts against the heat-conducting member are staggered along axes transverse to the elongated, heat-conducting member so that adjacent screws engage adjacent contacts at different locations to conserve space.

DESCRIPTION OF THE PREFERRED EMBODIMENT

The structure, manufacture, and use of the presently preferred embodiment of the invention will now be described after first briefly describing the drawings.

DRAWINGS

FIG. 1 is a perspective view of an electrical connector according to the invention.

FIG. 2 is a vertical sectional view, taken at 2—2 of FIG. 1, of the FIG. 1 connector.

STRUCTURE

Figure 3:
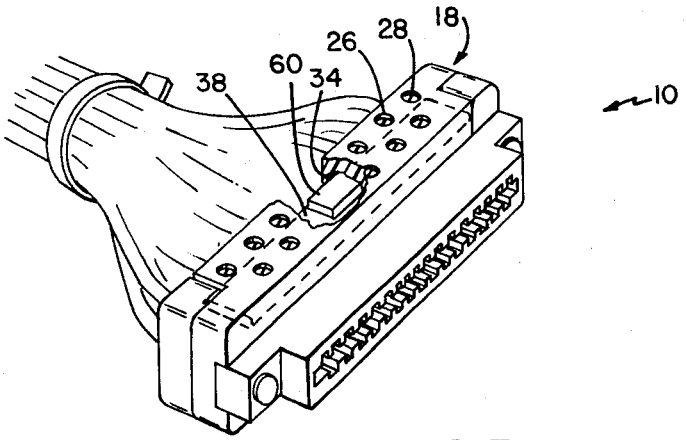
FIG. 3 is a perspective view, partially broken away, showing another embodiment of the FIG. 1 connector.

Referring to FIG. 1, there is shown electrical connector 10 for providing electrical connection between wires 12 and a printed circuit board (not shown) inserted in slot 14 between opposing pairs of contacts 16 (phosphor bronze per QQ-B-750, 0.000030 inch gold plated per MIL-G-45204 on mating surfaces over nickel per QQ-N-290.). Connector 10 is made of identical body pieces 18, 20 and connection piece 22, in which contacts 16 are embedded. Pieces 18, 20, 22 are made of glass filled polyester and are connected together by eyelets 24. Screws 26 are within staggered holes 28 to hold wires 12 and contacts 16 in electrical connection with each other and contacts 16 in heat-conducting relationship with a heat-conducting member, as is described in more detail below.

Referring to FIG. 2, it is seen that contacts 16 have converging inclined surfaces 30 extending below ribs 32 and extensions 36 extending from connection piece 22 into recess 34 provided between body pieces 18, 20. Between contact extensions 36, and also within recess 34, is a heat-conducting, electrically-insulating bar 38 of hard anodized 6101-T6 aluminum alloy. Stripped ends 40 of wires 12 are pressed against contact extensions 36 by screws 26, and contact extensions 36 are in turn pressed against heat-conducting bar 38. Heat-conducting bar 38 is retained in recess 34 between tabs 42 on one side and connection piece 22 on the other side. Holes 28 are staggered from adjacent holes in the same body piece, as is seen in FIG. 1. For each pair of opposed contacts 16, one is engaged by a screw 26 near its end, and the other contact is engaged by the screw 26 in the other body piece 16 at a position closer to connection piece 22. Heat-conducting bar 38 is also supported between opposing ribs 44 of body pieces 18, 20, which ribs separate adjacent wires and contacts.

Body piece 20 has arms 48, 49 that mate with recesses 50, 52 and body piece 18 similarly has arms that mate with similar recesses, not seen in FIG. 1.

MANUFACTURE

In manufacture, body pieces 18, 22 are fitted together with heat-conducting member 38 within recess 34. Contact extensions 36 are inserted into recess 34 between ribs 44, and end 54 of connection piece 22 fits within recess 56. Screws 24 are tightened to hold pieces 18, 20, 22 together. Wires 12 are stripped to expose ends 40, which are then inserted into their respective regions in recess 34 between ribs 44, and screws 26 are tightened to hold wires 12 and contacts 16 in place.

USE

In using connector 10, e.g., in a heat sensing instrument, a printed circuit board with metallized portions on both its upper and lower surfaces near an edge (not shown) is inserted into slot 14. The board is guided by inclined surfaces 30 of contacts 16 and by ribs 32. Because contacts 16 are resilient, they are pressed against the metallized portions to make good electrical contact with them. Contacts 16 are maintained within $\pm\frac{1}{2}$°C., because they are in heat-conducting relationship with heat-conducting bar 38. Thus, voltage and/or current discrepancies of thermal sensing conductors through contacts 16 owing to temperature differences is avoided.

OTHER EMBODIMENTS

Other embodiments of the invention within the scope of the appended claims will become apparent to those in the art. For example, a temperature sensor 60 (FIG. 3) can also be mounted within recess 34 in heat-conducting relationship with heat-conducting bar 38, to provide temperature information useful in analyzing electrical signals. Also, an insulated metallic bar can be used in place of aluminum bar 38.

What is claimed is:

1. An electrical connector comprising a body of insulating material, two rows of electrically-conducting contacts mounted on said body, said contacts defining an insertion region between opposing portions of first ends of said contacts, each said row having wire connection portions spaced from said opposing portions and defining a plane, a plurality of electrical wires, each touching a respective said contact at its wire connection portion, and an elongated heat-conducting, electrically-insulating member mounted between said rows and contacting said electrical contacts to maintain said contacts in both rows at the same temperature.

2. The electrical connector of claim 1 in which said heat-conducting member is an anodized aluminum bar.

3. The electrical connector of claim 1 in which said body and said plurality of contacts are adapted to engage the edge of a printed circuit board.

4. The electrical connector of claim 1 further comprising screws mounted in holes in said body to maintain said contacts in heat-conducting relationship with said heat-conducting member.

5. The electrical connector of claim 1 further comprising a temperature sensor in temperature sensing relationship with said heat-conducting member.

6. The electrical connector of claim 1 wherein said body comprises three plastic pieces, and said heat-conducting member is mounted within a recess provided by two of said plastic pieces and is held in place between tabs on said two plastic pieces and a third said plastic piece, said contacts being embedded in said third plastic piece.

7. The electrical connector of claim 6 further comprising screws in holes in said two plastic pieces to maintain said contacts in heat-conducting relationship with said heat-conducting member, said holes in the same said plastic piece being staggered along axes transverse to said elongated heat-conducting member so that adjacent said screws engage adjacent said contacts at different locations to conserve space.

8. The electrical connector of claim 1 wherein said member is an insulated metallic bar.

* * * * *